US005343572A

United States Patent [19]

Ament

[11] Patent Number: 5,343,572

[45] Date of Patent: Sep. 6, 1994

[54] PRESSURED TOILET TANK FLUSH VALVE

[75] Inventor: Myron Ament, Bethel Park, Pa.

[73] Assignee: Fluidmaster, Inc., Anaheim, Calif.

[21] Appl. No.: 90,336

[22] Filed: Jul. 12, 1993

[51] Int. Cl.[5] ..... E03D 3/10

[52] U.S. Cl. ..... 4/356; 4/354; 4/390; 4/391; 4/404

[58] Field of Search ..... 4/331, 332, 333, 334, 4/335, 336, 337, 354, 355, 356, 357, 34, 390, 391, 393, 395, 400, 404, 359; 137/599.2

[56] References Cited

U.S. PATENT DOCUMENTS

| | | | |
|---|---|---|---|
| 1,161,648 | 11/1915 | Fisher | 137/599.2 |
| 2,613,367 | 10/1952 | Denham | 4/391 |
| 2,767,406 | 7/1954 | Bennett . | |
| 2,907,109 | 10/1959 | Richardson . | |
| 3,011,176 | 12/1961 | Langdon | 4/356 |
| 3,026,535 | 3/1962 | Langdon | 4/358 |
| 3,095,577 | 7/1963 | Clark . | |
| 3,165,756 | 1/1965 | Simpson . | |
| 3,419,912 | 1/1969 | Kertell | 4/391 |
| 3,605,125 | 3/1970 | Gibbs . | |
| 3,733,618 | 5/1973 | Wiegand | 4/393 |
| 3,817,286 | 6/1974 | Caron . | |
| 3,955,218 | 5/1976 | Ramsey . | |
| 3,969,774 | 7/1976 | Karlsson | 4/391 |
| 4,698,859 | 10/1987 | Freed . | |
| 4,926,908 | 5/1990 | Dschida | 137/599.2 |
| 4,953,237 | 9/1990 | Perkins . | |

FOREIGN PATENT DOCUMENTS

| | | | |
|---|---|---|---|
| 206044 | 1/1909 | Fed. Rep. of Germany | 4/334 |
| 499132 | 11/1919 | France | 4/359 |

*Primary Examiner*—Ernest G. Cusick
*Assistant Examiner*—Charles R. Eloshway
*Attorney, Agent, or Firm*—Arthur Freilich; Robert D. Hornbaker; Leon D. Rosen

[57] ABSTRACT

A flush valve device is described for use in a toilet that includes a pressured water source, which can drain away water in the event of excess pressure with minimal modification to the toilet and which facilitates initial operation of the flush valve device. The flush valve device includes a valve member (16, FIG. 2) which lifts off a valve seat (22) at the beginning of a flushing, the valve member carrying a pressure operated relief valve (50) which dumps water at excess pressure through the opening (52) within the valve seat, to avoid the need for additional fluid-tight couplings in the water source. The valve member includes a sealing portion (60) which normally lies against the valve seat and which is lifted completely away from the valve seat during a flushing. A manually operated flushing mechanism which lifts the valve member off the valve seat, is coupled to the outer end (80) of the sealing portion, with the outer end of the sealing portion being flexible enough that it progressively peels away from the valve seat at the beginning a flushing. The peeling away allows the escape of some water through the valve seat to facilitate the liftoff of the rest of the sealing portion from the valve seat.

3 Claims, 2 Drawing Sheets

PRESSURED TOILET TANK FLUSH VALVE

BACKGROUND OF THE INVENTION

One type of toilet includes a pressured water source, where the pressure of water at the flush valve seat is greater than that due to a moderate height of water above the valve seat. Such toilets are often of the "low profile" type, and the toilet may be either a urinal type which has a small bowl or a sit-down type which has a toilet seat. If the inlet valve should leak, so that the water pressure in the source exceeds a predetermined level, then water must be drained from the source, either into the toilet bowl or into the toilet bowl outlet that leads to the drain. Unless the water source is designed to withstand very high city water pressures such as over 100 psi, which would make a moderate capacity water source very cumbersome and expensive, the alternative is to allow bursting of the water source and flooding of the washroom. A pressure relief valve can be placed anywhere in the water source, and its outlet can be connected to the toilet bowl or toilet bowl outlet, but such additional connections must be water tight and can add substantially to the cost of the toilet. A pressure relief valve which minimized the number of fluid tight connections that had to be made, would be of considerable value.

The force required to initially lift the flush valve member off the valve seat to begin a flushing, depends upon the pressure of water at the valve seat. A typical home gravity toilet (nonpressurized) stores water at a height of about 15 inches above the valve seat, where the water is at a pressure of about 0.54 psi. A pressure toilet may store water at a considerably higher pressure such as 1 psi. As a result, a larger force is normally required to lift the valve member off the valve seat. It is possible to use leverage so a low force can lift the valve seat, but this results in the need for the force to be applied over a longer distance. A flush valve device which could enable liftoff of the valve member using a moderate force applied over a moderate distance, would be of value for pressured water toilets.

SUMMARY OF THE INVENTION

In accordance with one embodiment of the present invention, a flush valve device is provided which safeguards against excess water pressure and which facilitates a flushing operation. The flush valve device includes a common valve seat with a hole that leads to the toilet bowl, and a valve member which is lifted off the valve seat at the beginning of a flushing. Water at an excess pressure is disposed of by a pressure operated relief valve which opens to a region within the valve seat, to discharge water through the same opening through which flush water is normally discharged, to thereby minimize the number of fluid tight connections required in the toilet. The pressure operated valve is preferably mounted on the valve member, and opens into the hollow float of the valve member to discharge water into the float and out through its open lower end.

Initial opening of the valve member is facilitated by constructing the sealing portion of the valve member, which lies directly against the valve seat, so the sealing portion has a flexible outer end. Lifting force is applied to the flexible outer end, which peels the flexible outer end progressively away from the valve seat to allow the escape of some water into the flush conduit before most of the sealing portion is lifted off the valve seat. The water that initially escapes reduces the differential pressure across the valve member, so that less force is required to lift the rest of the sealing portion off the valve seat. An operated flush device which applies upward force to the valve member, is constructed so for a constant applied force, a large initial liftoff force is applied with the liftoff force rapidly decreasing as the valve member is lifted progressively higher.

The novel features of the invention are set forth with particularity in the appended claims. The invention will be best understood from the following description when read in conjunction with the accompanying drawings.

DESCRIPTION OF THE PREFERRED EMBODIMENT

Figure 1:
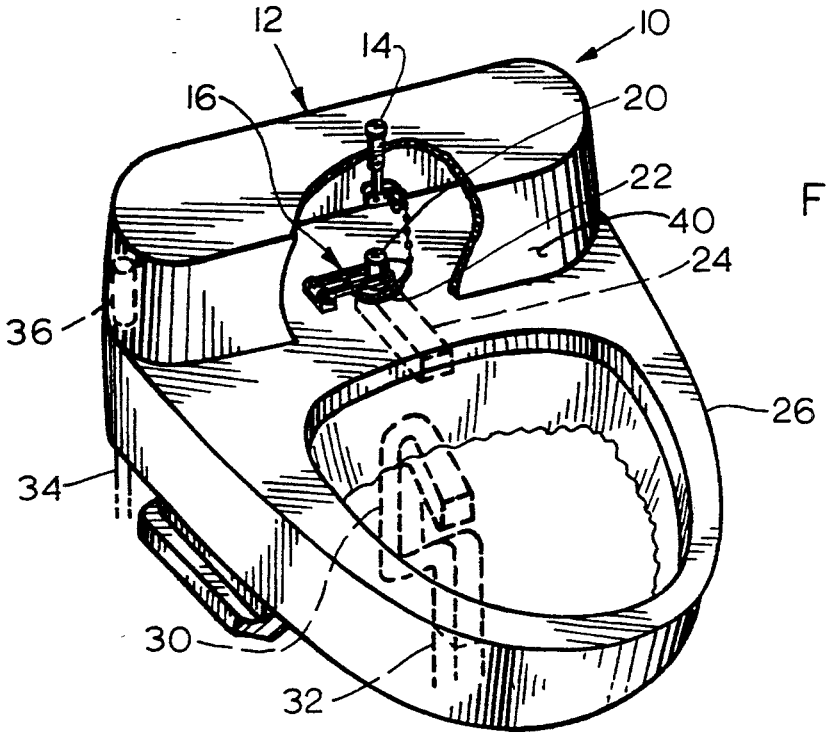
FIG. 1 is a partially sectional isometric view of a toilet constructed in accordance with the present invention.

FIG. 1 illustrates a toilet 10 of the low profile type, which has a source 12 of pressured flush water. A manually movable member such as button 14 is operated, as by depressing the button, to operate a flush valve device 16. The flush valve device includes a valve member 20 that lifts off a valve seat 22 to allow flush water to pass out of the source 12 through a water tunnel or flush conduit 24 to a toilet bowl 26. Water and debris in the toilet bowl then pass out through a toilet bowl outlet 30 to a drain 32. An air inlet valve (not shown) admits air into a housing 40 of the source during the flushing; such inlet valve may be of the type shown in U.S. Pat. No. 3,605,125. When water has been flushed out of the water source 12, additional water passes into the source from a water line 34 which may be connected to a municipal water source, and through an inlet valve 36 to the pressured water source 12.

The pressured water source 12 may hold water at a pressure on the order of magnitude of 1 psi. Experience has shown that such water pressure produces good flushing. A much higher pressure (e.g. over 10 psi) would require thick walls for the housing 40 of the source, which would greatly increase its cost. The line 34 which is connected to a municipal water source, may carry water at a pressure exceeding 100 psi. Therefore, if the inlet valve 36 should malfunction so that when it is supposed to be closed it leaks water from the line 34 into the source 12, then the source housing 40 could burst and flood a washroom. To prevent such occurrence, a pressure relief valve is required which drains water at excess pressure (e.g. such as 1.25 psi for a source normally operating at 1 psi) out of the pressured water source. The outlet of such relief valve must deliver the water to the toilet bowl 26 or the toilet bowl outlet 30, or in some other manner to the drain 32. Such outlet could require a separate conduit with fittings at its opposite ends which must be sealed water tight against pressured water, which could significantly increase the cost of the toilet.

In accordance with the present invention, applicant provides a pressure relief valve 50, (FIG. 2) which releases water through the hole or opening 52 of the valve seat 22 against which the flush valve member 16 normally seals. The particular flush valve member 16 includes a hollow float 54 which has a closed upper end 56 and an open lower end 58. The float includes an annular sealing portion 60 which extends 360° around the float and which seals against the upper surface 62 of the valve seat. The float is supported by a rigid yoke 64 which can pivot about a pivot axis 66 to raise and lower the float. A shaft 70 extending through the inner end 72 of the yoke and flush valve member, is pivotally mounted on a bracket 74 that is mounted on the housing 40 of the water source. When a chain 76 is pulled to lift the outer end 80 of the flush valve member, the sealing portion 60 of the valve member lifts off the valve seat 22 and water begins to flow out of the water source through the flush conduit 24 to the toilet bowl. As soon as water flows into the flush conduit 24, which reduces the pressure differential across the float, the hollow float 54 floats in the remaining water of the water source, to the position shown at 16A. This is typical of prior art flush valve movement. It may be noted that some prior art flush valve include a soft rubber yoke whose inner end is fixed and with the soft rubber yoke flexing to permit the float to pivot up and down off and against the valve seat.

Applicant places the pressure relief valve 50 on the flush valve member 16. The pressure relief valve 50 includes a relief valve member 84 which is upwardly biased by a spring 86. However, the relief valve member 84 can move down to move a closing part 90 away from a seat 92 and allow water to flow out of the relief valve outlet 93 along a path 94. The water pressure at which the relief valve member 84 moves down to open the relief valve, depends upon the precompression of the spring 86, and on the difference in pressure between the pressure of water in the source 12 and atmospheric pressure in the flush conduit 24. The relief valve 50 normally will open only when the flush valve member 16 is in its down position.

When the relief valve 50 opens, it passes water down through the same hole or opening 52 through which water is normally flushed at the beginning of a flushing operation. That is, water flowing out through the relief valve flows out through a region 96 which lies within a vertical extension of the valve seat opening 52. Actually, relief water passing along the path 94 moves into the hollow float 54 and out through the open end 58 of the float into the flush conduit. This arrangement avoids the need for a separate hole in the housing 40 of the pressured water source through which a relief pipe can extend into the toilet bowl, its outlet, or the drain, and avoids the need for fluid tight couplings at opposite ends of such a pipe. It may be noted that it is possible to form a small relief valve along the valve seat 22 to also flow water through the opening 52 into the flush conduit 24. While the relief valve is especially useful for water enclosed in a sealed tank where the water pressure is greater than that due to the height of the water, such a relief valve may also be useful in certain toilets where water may extend to a large height above the valve seat.

Figure 4:
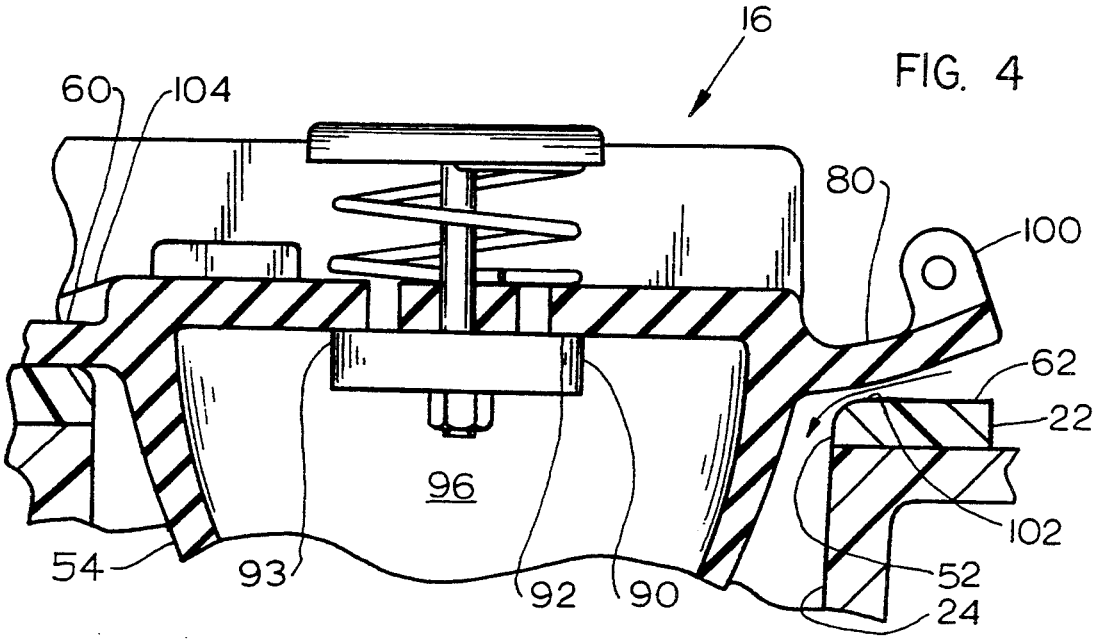
FIG. 4 is a partial sectional view of the flush valve device of FIG. 2, shown during partial liftoff of the valve member.

The most common type of home toilet stores water at a height of about 15 inches, so the pressure difference across the valve seat member, which must be overcome to begin a flushing, is about 15 inches of water (about 0.53 psi). A higher pressure such as about 1 psi is desirable for a pressure water source, as such a higher pressure produces a better flushing and does not require a taller water tank. However, it may require a person to apply greater force to initially lift the flush valve member off the flush valve seat. As shown in FIG. 4, applicant reduces the manual force that must be applied to begin a flushing, by constructing the outer end 80 of the sealing portion 60, to enable only the outer end 80 to lift off the upper surface 62 of the valve seat 22 before the rest of the sealing portion lifts off the valve seat. The flexible part 80 of the sealing portion can be constructed of an unsupported layer of soft rubber (e.g. durometer 50), with a coupling 100 thereon to which a chain or rope is attached. When the chain is lifted, the flexible outer end part 80 progressively peels away from the valve seat surface 62, until there is a relatively small gap 102. The pressured water rapidly flows through the small gap 102, which quickly widens. The somewhat pressured water under an area of the sealing portion 60 reduces the pressure difference against which the flush valve member 16 must be lifted by at least 10%, before the rest (over 50%) of the sealing portion is lifted off the valve seat. The gap 102 is at least 0.5 mm before most of the sealing portion lifts off the valve seat. As a result, continued upward force causes the entire sealing portion 60 to lift off the valve seat. As discussed above, once the sealing portion has lifted off the valve seat, the float 54 causes the valve member to rapidly rise in the water and allow flush water to rapidly flow out through the opening 52 into the flush conduit 24. It may be noted that applicant prefers to provide ridges 104 to rigidize the rest of the sealing portion 60 which is inward of the flexible outer end part 80. The rigidized portion, which lifts in unison off the valve seat, preferably extends over 180° around the sealing portion. It is possible to locate the flexible sealing part 80 at a side of the sealing portion which is not directly opposite the pivot axis 66 of the flush valve member.

Figure 2:
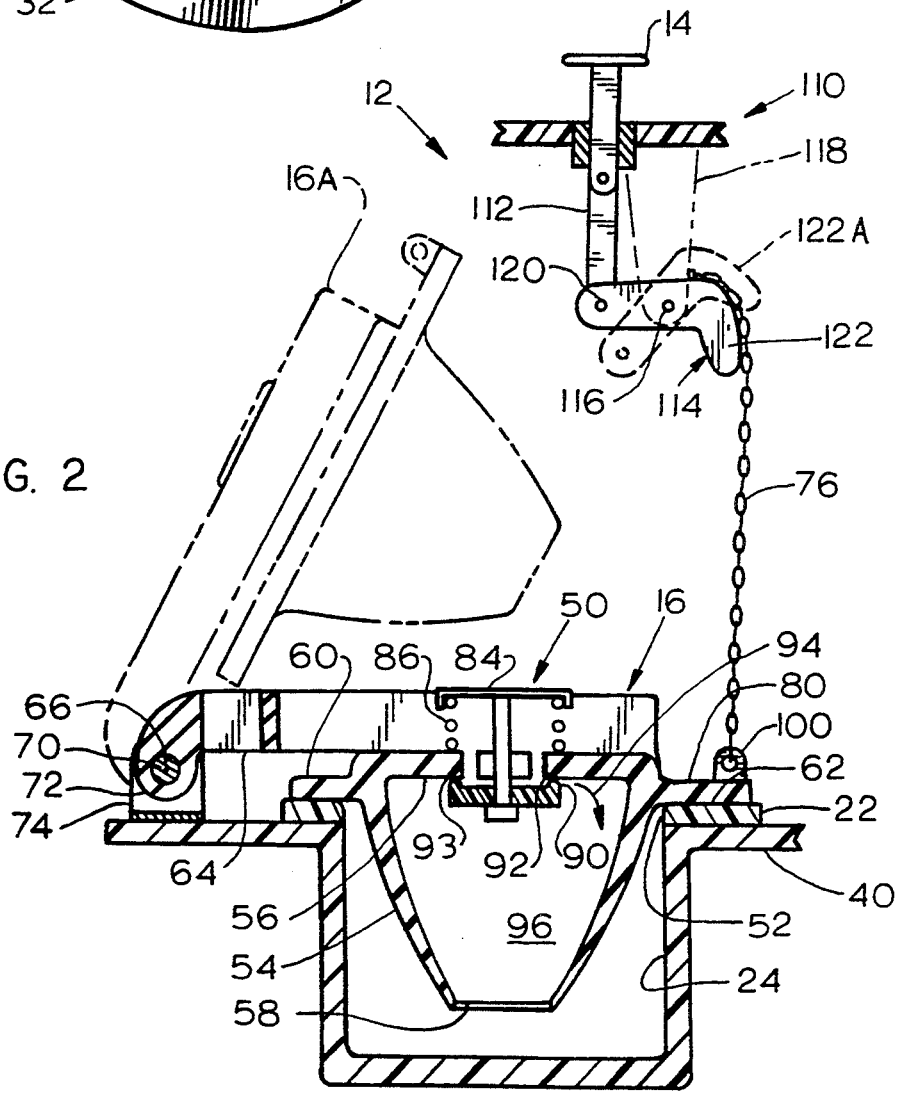
FIG. 2 is a sectional side view of the flush valve device of the toilet of FIG. 1, with the flush valve member in its fully closed position.
Figure 3:
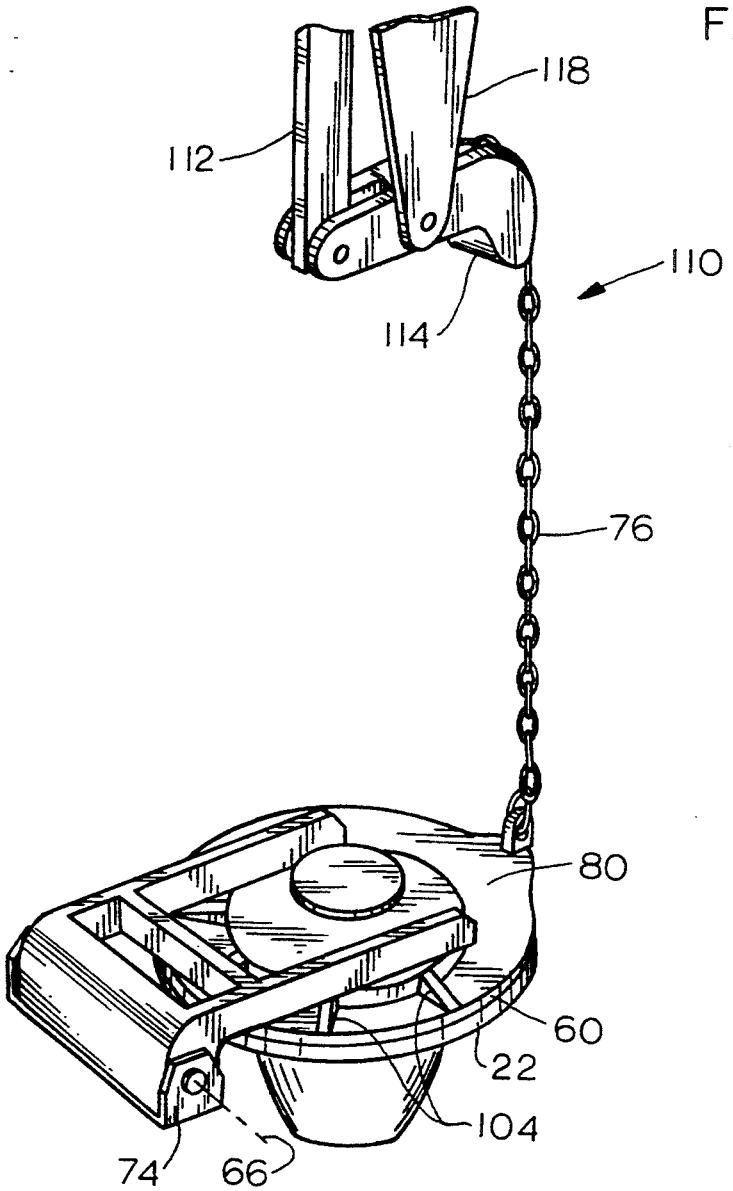
FIG. 3 is a partial isometric view of the flush valve device of FIG. 2.

Applicant minimizes the force that must be applied to begin a flushing, by a manually operated flushing mechanism or device 110 that is especially constructed for this purpose. As shown in FIG. 2, the mechanism 110 includes the push button 14 which is connected by a first link member 112 to a cam 114. The cam is pivotally mounted about an axis 116 on a pair of brackets 118 that are attached to the housing of the water source. A second member in the form of chain 76 couples the opposite end 122 of the cam 114 to the coupling 100 at the outer end of the flush valve member. It can be seen that when the button 14 is depressed, the axis 120 of pivotal connection of the link 112 to the cam, moves horizontally progressively closer to the pivot axis 116 of the cam. As a result, there is large "leverage" when the button is first depressed, so only a moderate initial force is required to depress the button to initially lift the flexible outer end 80 of the flush valve member sealing portion. Applicant also constructs the end 122 of the cam so it moves to the position 122A wherein it moves further away from the pivot axis 116 as the button continues to be depressed. At least the cam end 122 does not move toward the cam pivot axis 116 as fast as the axis 120, and in fact moves away from it. Thus, after a moderate force is applied to initially lift the flush valve member, additional force applied over a short distance to the button 14, results in a progressively larger upward movement of the flush valve member to complete the liftoff. After lifting has begun, the force required for liftoff rapidly decreases, so the decrease in "leverage" does not require a person to press very hard on the button. When the valve member lifts up to the position 16A, the chain 76 hangs in loose loop.

Thus, the invention provides a flush valve device which is especially useful for toilets having pressured water sources where the pressure of water at the flush valve is greater than that resulting solely from the height of the water above the flush valve, which provides efficient pressure relief and low force opening of the flush valve. A pressure relief valve opens to a hole or opening within the valve seat, such as to the inside of a hollow float, to avoid the need for an additional pipe to carry away excess water in the pressured water source. Initial opening of the flush valve is facilitated by constructing a flush valve member with a sealing portion whose outer end is flexible, so it can be progressively peeled away from the valve seat to allow the beginning of water escape, before the rest of the sealing portion is lifted off the valve seat. Eventually, the entire sealing portion is lifted off the valve seat for the rapid outflow of water to enable efficient flushing. An operated flushing mechanism is constructed so a moderate initial manual force results in a large force lifting up the flush valve member, with the leverage decreasing as the flush valve member is progressively lifted. It should be noted that the present invention is useful not only for a sit-down type of toilet which is illustrated (which can hold a toilet seat), but also for urinals (where the toilet bowl is smaller). Also, while most toilets are designed to be manually flushed, some toilets are nonmanually flushed, as where urinals are automatically flushed at intervals of perhaps 5 minutes during periods of use.

Although particular embodiments of the invention have been described and illustrated herein, it is recognized that modifications and variations may readily occur to those skilled in the art, and consequently, it is intended that the claims be interpreted to cover such modifications and equivalents.

I claim:

1. A toilet which includes a toilet bowl, a flush conduit for passing water to said bowl, a source of flush water which holds water under pressure, and a flush valve device which is operable to flow water out of said source and into said flush conduit at the beginning of a flushing, wherein:

said flush valve device includes a valve seat with an opening that leads to said flush conduit, and a flush valve member which includes a float which lifts off said seat at the beginning of a flushing;

said flush valve device includes a pressure relief valve which is mounted on said flush valve member and which opens to a region within said valve seat opening, said pressure relief valve being constructed to open at a predetermined pressure difference between the pressure of water in said source and air pressure in said flush conduit, to thereby drain high pressure water in said source through said valve seat opening to said toilet bowl when said predetermined pressure difference is reached.

2. The toilet described in claim 1 wherein:

said hollow float has an open lower end, and said pressure operated valve is mounted on said flush valve member and opens into said hollow float.

3. A method for use with a toilet which includes a pressure water source, a toilet bowl, a flush valve device with an opening and a valve seat around the opening and a float valve member which can lift off said seat and float in water to discharge flush water through said opening, and a water tunnel which connects said opening to said toilet bowl, to release pressured water in said source when said pressured water reaches a predetermined pressure, comprising:

releasing water in said source when said pressured water exceeds said predetermined pressure, through a pressure relief valve mounted on said valve member and said opening through which flush water flows when said valve member lifts off said valve seat.

* * * * *